United States Patent [19]

Wasemann

[11] Patent Number: 4,502,303

[45] Date of Patent: Mar. 5, 1985

[54] WASHING MACHINE TUB CONSTRUCTION

[75] Inventor: William A. Wasemann, Mansfield, Ohio

[73] Assignee: White Consolidated Industries, Inc., Cleveland, Ohio

[21] Appl. No.: 546,847

[22] Filed: Oct. 31, 1983

[51] Int. Cl.[3] ..... D06F 37/24

[52] U.S. Cl. ..... 68/23.2

[58] Field of Search ..... 68/23.2, 23 R, 23 A, 68/23.3, 23.5; 210/144, 363, 364; 74/573 R; 494/82

[56] References Cited

U.S. PATENT DOCUMENTS

| | | | |
|---|---|---|---|
| 2,926,136 | 2/1960 | Smith et al. | 210/360.1 |
| 2,972,877 | 2/1961 | Platt | 68/23.5 X |
| 3,269,544 | 8/1966 | Brucken et al. | 210/364 |
| 3,278,037 | 10/1966 | Stelli et al. | 68/23.2 X |
| 3,475,928 | 11/1969 | Wasemann | 68/23.2 |
| 3,663,975 | 5/1972 | Fish et al. | 68/23.5 X |
| 4,044,626 | 8/1977 | Hayashi et al. | 68/23.2 X |

FOREIGN PATENT DOCUMENTS

| | | | |
|---|---|---|---|
| 232204 | 1/1961 | Australia | 68/23 R |
| 23871 | 2/1977 | Japan | 68/23.2 |
| 140869 | 12/1978 | Japan | 494/82 |
| 2029864 | 3/1980 | United Kingdom | 68/23.2 |

*Primary Examiner*—Philip R. Coe

*Attorney, Agent, or Firm*—Pearne, Gordon, Sessions, McCoy, Granger & Tilberry

[57] ABSTRACT

A top loading clothes washing machine has a resiliently mounted outer tub within which is a spin tub mounted for rotation about a vertical axis. At its upper end, the spin tub has a weighted balance ring releasably mounted on the inner side of the spin tub and extending toward the central axis to serve as a clothes guard. The balance ring is formed of a concrete aggregate material and is completely covered with a plastic material. The outer tub has a top cap with a spray tube on the underside extending around the periphery of the top cap and the tube has discharge openings directed into a spray channel which breaks up the stream of water and directs it downwardly onto the clothes within the spin tub.

3 Claims, 6 Drawing Figures

WASHING MACHINE TUB CONSTRUCTION

BACKGROUND OF THE INVENTION

This invention relates generally to clothes washing machines, and more particularly to clothes washing machines of the top loading type having a resiliently mounted, non-rotary outer tub and an internal spin tub rotating about a vertical axis.

Clothes washing machines of the top loading type have a cabinet comprising a base, four sidewall portions, and a top having therein a lid to allow access into the spin tub, which usually has an agitator mounted on the axis and which, in turn, is rotatably mounted within an outer tub. Generally, the spin basket is perforate to allow water removal during centrifugal extraction, while the outer tub is imperforate and serves to contain the liquid washing medium. The outer tub has a mounting assembly which includes a transmission, drive motor, and pump, and is resiliently mounted to absorb vibration from unbalanced loads that occur particularly during the acceleration and high speed during the spin or centrifuging portion of the cycle. While many arrangements are provided for mounting the tub, transmission, and other components, a common arrangement is to have them mounted on a dome-type assembly on the base and anchored by springs extending between the tub mounting assembly and the base to hold the entire outer tub and related assemblies in a centered position with regard to the sidewalls of the cabinet and the top opening. Generally, the outer tub is made as small as possible to provide a minimum clearance around the spin tub, so as to minimize the amount of water used in a wash cycle. Of course, it is possible to select various fill levels for water during the portions of the cycle.

Of particular concern with machines of this type is the necessity for avoiding excessive movement of the outer tub and mounting assembly because of unbalanced loads of clothes in the spin tub during the spin operation, and particularly during the acceleration phase of the spin tub when, depending upon the amount and location of the load, it is possible to encounter resonant frequencies which could result in excessive excursions of movement, causing the outer tub to strike the walls of the cabinet. While such excessive excursions can be prevented by using an unbalance switch which detects such excessive movements of the tub and de-energizes the drive motor, so that the clothes can be physically rearranged to correct the unbalance, it is desirable to tolerate certain excursions during the spin-up portion of the cycle, since such excursions in the movement of the tub may substantially decrease once the full spin speed is reached.

In order to minimize the magnitude of the excursions of the tub, it is possible to increase the force of the centering springs, but if these are made too stiff, other problems may be encountered as a result of the complex dynamics of the rotating system. However, generally two other approaches are used, both of which involve increasing the mass of the suspended tub assembly so as to thereby decrease the effects of unbalanced loads. One such approach is simply to increase the weight of the outer tub assembly, preferably at a point as high above the base as possible. This can be done by adding weights to the exterior of the tub, as disclosed in U.S. Pat. No. 3,475,928. Another approach has been to use a weight ring at the top of the spin basket, as shown in T. R. Smith U.S. Pat. No. 2,926,136, which has an additional gyroscopic stabilizing effect during spin because of the rotation of the mass.

While the first of these solutions has the advantages of being relatively simple and low cost in manufacture, it does require substantially heavier weights than the rotating ring, and these weights add to shipping costs and make the unit more difficult to move if necessary for service. Furthermore, such weights function only when attached to the outer tub, and when such tub is made of a heavy steel construction, no problem is presented. However, if the outer tub is made of a plastic material, to decrease the weight and increase the corrosion resistance of the unit, such material is not stiff enough to support the weights in their normal position.

On the other hand, while a rotating annular ring of weighted material at the top of the spin tub does not require nearly the mass of the stationary weights, it does require a much more complex and precise construction for the spin tub to avoid any unbalance caused by nonuniformity of the balance ring itself. Heretofore, such balance rings have usually been built into the spin tub structure itself, using several walls and an inwardly projecting structure which is difficult to form with a high degree of accuracy, since such tubs are usually made of a porcelain enameled steel, which is easily distorted under the high temperatures required for the porcelain enameling operation. For this reason, the use of a heavy weight ring built into the top of the spin tub has resulted in an increased cost of manufacture over the external weight arrangement.

Another problem presented by such top loading washing machines is the necessity to control the clothes within the spin tub and prevent their escape therefrom. For example, if small articles of clothing come out of the spin tub and enter the space between the spin tub and the outer tub, it is almost impossible to remove them without disassembling the machine, and they can reach locations where they can cause substantial damage upon continued operation of the machine. For this reason, it is a usual construction to provide a clothes guard in the form of an annular piece that mounts at the top on the inside of the spin tub and extends toward the central axis so that small clothing articles are retained within the spin tub.

Likewise, to ensure that space between the spin tub and the outer tube is not readily accessible, an annular cover is used over the outer tub extending radially inward over the clothes guard on the spin tub, and generally provides a configuration to define an opening which corresponds with the opening through the top of the cabinet to prevent the possibility that during the filling or removal of clothes any such clothes can pass outwardly above the outer tub and fall down into the mechanism within the cabinet. Such tub cover generally also functions to mount such items as bleach dispensers and lint filters, and generally provides the mount for the fill nozzle by which the tub is filled during the wash and rinse cycles. The fill nozzle mounted in the tub cover generally is intended to spray downwardly on the clothes which may be adhering to the sides of the spin tub, as is particularly desirable in the case of a spray rinse after the first centrifugal extraction cycle of the washing medium, but since the machine is generally not rotating during other fill cycles, this results in a concentration of the incoming water at a particular spot. To overcome this, it has been proposed that the fill system use a tube extending around the bottom side of the tub cover inwardly of any projection of the spin tub or clothes guard and having openings to spray downwardly on the clothes. Such an arrangement is shown in U.S. Pat. No. 3,663,975, in which a rubber tube is mounted on the underside and has a plurality of slots so that the spray water is distributed over the entire periphery of the spin basket and the clothes therein, even when the basket is not rotating during a fill operation. However, such a construction has required the use of a rubber tube for mounting purposes, and the openings in such tube can easily be distorted with wear and age, and have little control over the radial direction of spray during a fill or rinse cycle.

SUMMARY OF THE INVENTION

The present invention relates to the structure of the outer tub and spin tub of a top loading washing machine having a gyroscopic type of suspension.

According to one aspect of the present invention, stability of the gyroscopically mounted structure is enhanced during the spin operation of the spin tub by adding weight in the form of an annular balance ring at the top of the spin tub. The balance ring is in the form of a separable part that is bolted in place at the top of the spin tub, and is therefore easily removable and replaceable without complete disassembly or removal of the spin tub. The balance weight is in the form of a heavy, rigid material, such as a form of concrete having its density enhanced, if desired, by incorporating denser material such as a high density aggregate material or steel shot, and it is completely enclosed and encapsulated in an outer supporting structure, such as a suitable plastic material.

According to another aspect of this invention, the annular balance ring incorporating the heavy material is so mounted that it makes a substantially close sealing fit against the inner surface of the spin tub adjacent the upper opening thereof, and extends a distance radially inwardly toward the axis of rotation so as to provide a clothes guard to prevent the escape of articles of clothing within the spin tub outwardly into the area between the spin tub and the outer tub. Accordingly, the radially inner edge of the balance ring may be configured to aid in the clothes guard function of the balance ring.

According to another aspect of the invention, the outer tub is enclosed at the top by an inwardly extending tub cover which is removable to obtain access to the balance ring. The cover is configured to cooperate with the upper surface of the balance ring to prevent the escape of clothing from the spin tub, and is also configured to cooperate with the opening in the top of the cabinet to prevent the escape of articles of clothing between the outer tub and the enclosing cabinet structure. The tub cover extends radially inward to a point somewhat closer to the axis of rotation than the innermost points of the balance ring and clothes guard member, where it is provided with a number of vertical spray channels. The incoming water passes into a tubular manifold extending around the underside of the tub cover, and has discharge openings designed, during the fill and spray rinse operations, to direct a jet of water against a wall of the ends of the spray channels on the tub cover to break up the stream and provide a downwardly directed spray of water at spaced places around the periphery of the spin tub and onto the clothes adjacent the wall of the spin tub.

These and other aspects and advantages of the invention are more fully described in the following detailed description, and shown in the accompanying drawings.

DETAILED DESCRIPTION OF THE INVENTION

Figure 1:
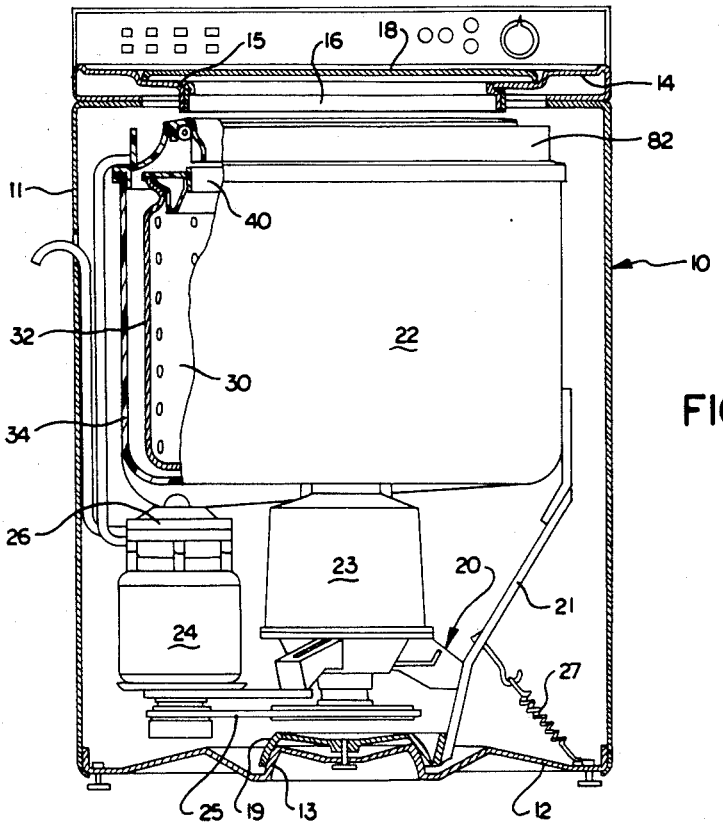
FIG. 1 is an elevational view of a top loading clothes washing machine, partially in section, incorporating the present invention.

As shown in FIG. 1, a typical top loading clothes washing machine includes a cabinet 10 having sidewall panels 11 extending upwardly from a base 12. Above the sidewalls 11 is a horizontal top wall 14 having a centrally located, recessed portion 15 which defines an access opening 16 and is covered by a suitably hinged door or lid 18.

Within the cabinet 10, the washing machine mechanism includes a support frame, indicated generally at 20, which at its lower end includes an inverted cup 19 mounted on a dome 13 formed on the cabinet base 12 at the center thereof. The support frame includes braces 21 extending upwardly and outwardly from the cup 19 to the outer tub 22 in the upper part of the cabinet 10 directly above the dome 13. This arrangement allows the outer tub 22 to pivot about a point located on the center of curvature of the dome 13, which is located below the base 12 and suitable friction means (not shown) are mounted between the cup 19 and the dome 13 to dampen movement therebetween. The transmission 23 is located centrally below the outer tub 22 and is driven by motor 24 through drive belt 25. A suitable pump 26 is mounted on top of the motor 24 and centering springs, indicated at 27, extend from the braces 21 down to points on the outermost edge of the base 12 to center the support frame and outer tub along a vertical axis to ensure that the outer tub 22 will be centered with respect to the access opening 16.

A spin tub 30 is mounted inside the outer tub 22 for rotation about a vertical axis and is driven by the motor 24 through the transmission 23. The transmission 23 may also drive a suitable agitator (not shown) within the spin tub which is normally non-rotating about the agitator is in operation while the spin tub 30 is rotated at a relatively high rate of speed for the centrifugal extraction portion of the washing cycle. The spin tub 30 has a circular, peripheral wall 32 extending closely adjacent the cylindrical sidewall 34 of the outer tub 22, and at its upper end the wall 32 has a reduced diameter neck 36 and an outwardly flaring upper end 37 terminating at an edge 38.

A balance ring or weight ring 40 is mounted within the spin tub 30, and rests on the flaring portion 37 of the spin tub, where it is held in place by suitable bolts indicated at 41. The balance ring 40 is formed as a hollow, annular structure of suitable plastic material, such as a filled polypropylene, and comprises a body member 42 and a cap 43. These members define a substantially uniform wall structure completely enclosing an annular space which is filled with a suitable weight material, such as a concrete or Portland cement mixture whose density may be increased by the use of either a heavy aggregate or metal shot particles to give the ring the necessary mass.

Figure 5:
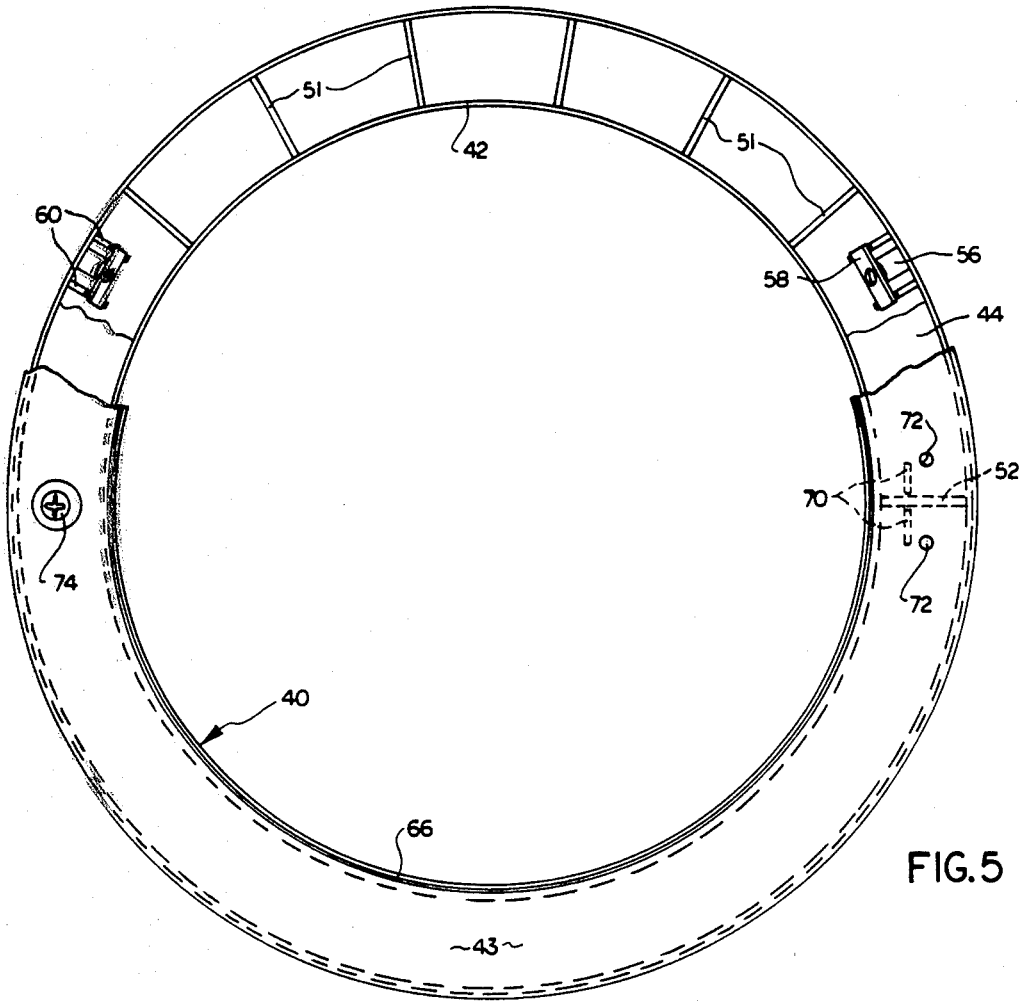
FIG. 5 is a top elevational view, partly in section, of the balance ring and clothes guard member.
Figure 6:
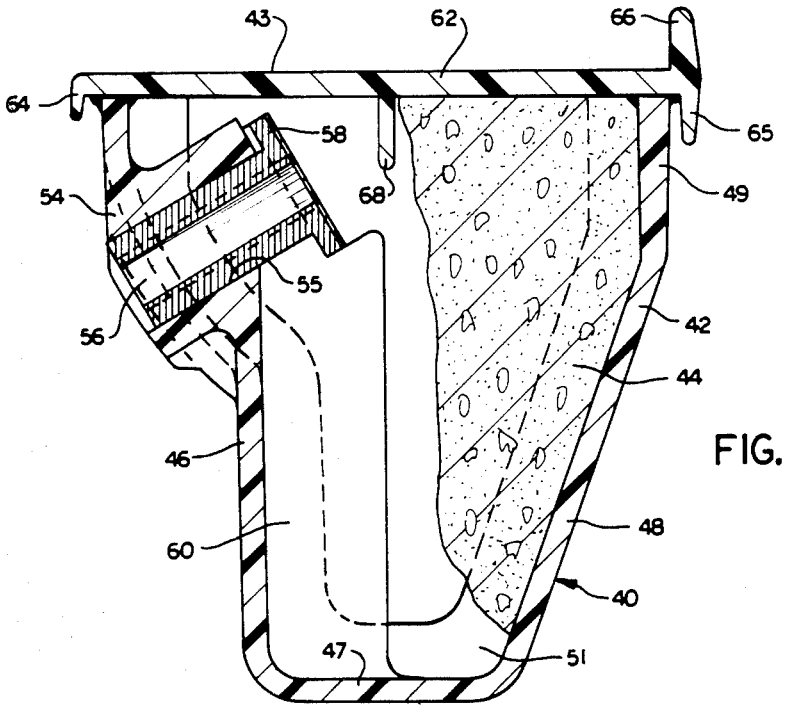
FIG. 6 is an enlarged, cross-sectional view through the balance ring and clothes guard member taken on line 6—6 of FIG. 5.

The body 42 includes a generally vertically extending, outer wall 46, and a bottom wall 47, which is joined to a sloping inner wall portion 48 and a vertical inner wall portion 49 above the sloping portion 48. These walls are all generally of uniform thickness, but to increase the rigidity so that the ring will maintain the necessary dimensions when filled with the liquid concrete before it has set, the interior is provided with a plurality of inner reinforcing ribs 51 on the inside of the wall portions 46–49 at a plurality of spaced points around the ring. At the location of one of these ribs is a solid web 52 (see FIG. 5) which completely blocks off the interior of the body 42 by extending fully over the cross-sectional area of the body.

In order to mount the ring, the body member is provided with a plurality of bosses 54, preferably at least three in number, to allow the balance ring to be mounted on the spin tub. These bosses 54 are at thickened portions of the plastic material and are provided with a bore 55 extending angularly therethrough to receive a nut 56 to which one of the bolts 41 is threadedly connected to clamp the balance ring firmly in place in the spin tub. The nuts 56 have a T-bar portion 58 on the inner end thereof, which seats on ribs 60 formed on either side of the boss 54 and extends downwardly along the outer wall 46 to effectively prevent the nut 56 from rotating. The bosses 54 project outwardly from the wall 46 a slight distance in a direction along the axis of the bores 55 so that the balance ring contacts the spin tub only at these points to ensure a positive clamping action by the bolts 41.

The cap 43 includes a horizontal top wall portion 62 extending radially over the open upper portion of the body 42. The cap 43 on the outer side has a downwardly extending flange 64 which fits outwardly of the body outer wall 46. Likewise, on the inner edge of the top portion 42, the cap has an inner flange 65 similar in shape to flange 64 extending downwardly on the inner side of vertical inner wall 49. Above the inner flange 65 is located an upwardly projecting, thickened annular rib 66 which assists in preventing the clothes from escaping the spin tub and ensures that the balance ring will not present any sharp edges to the user of the washing machine. The cap 43 may be provided with peripherally extending rib portions 68 on its underside to provide additional stiffness and at a point which is selected to be coincident with the solid web 52 in the body 42, has a pair of centering ribs 70 adapted to extend downwardly on each side of the solid web 52 to positively position the cap 43 rotationally with respect to the body 42 during assembly. Closely adjacent the centering ribs 70 are a pair of vent holes 72 extending through the top wall portion 62 and 180 degrees away from the vent holes 72 is a fill opening 74 which may be covered by a suitable cap (not shown).

The balance ring 40 is manufactured by molding the body 42 and cap 43 as separate pieces and the nuts 56 are pressed into the bores 55 from the inner side and any open bore in the nut is covered by tape. After the cap 43 is assembled on top of the body 42, the interior being entirely empty at this point, the two members are secured together by vibration welding so that the bottom surface of the top wall 62 of cap 43 is solidly welded to the top portions of the outer wall 46 and vertical inner wall 49. When this has been done, a suitable concrete in liquid form is then injected through the fill opening 74, where it flows in both directions around the periphery of the ring until it reaches the solid web 52 on the opposite side. This flow will take place in both directions, since the air present within the hollow balance ring will escape through the vent holes 72, and when both vent holes 72 show the presence of the liquid concrete and all of the air has been removed, the fill opening 74 can then be covered and the concrete material allowed to harden. After the concrete has hardened, the balance ring may then be mounted in place on top of the flaring portion 37 of the spin tub 30 by means of the bolts 41.

Figure 2:
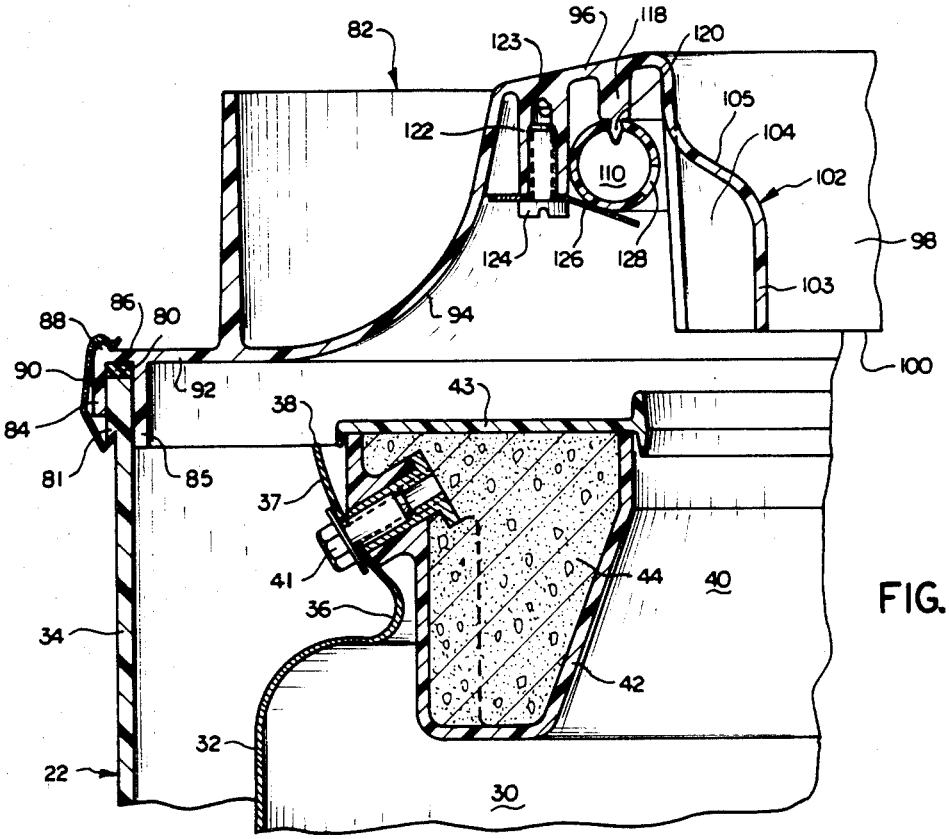
FIG. 2 is an enlarged, fragmentary, cross-sectional view of the balance ring and tub top construction of the machine shown in FIG. 1.
Figure 3:
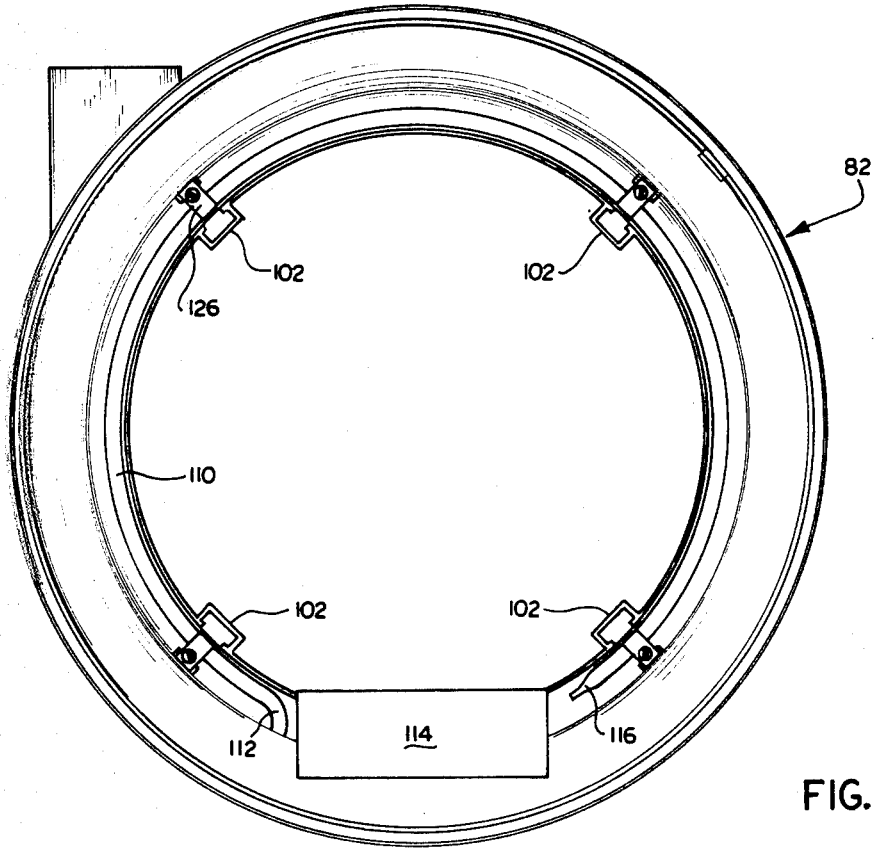
FIG. 3 is a bottom view of the tub top cap shown in FIGS. 1 and 2.
Figure 4:
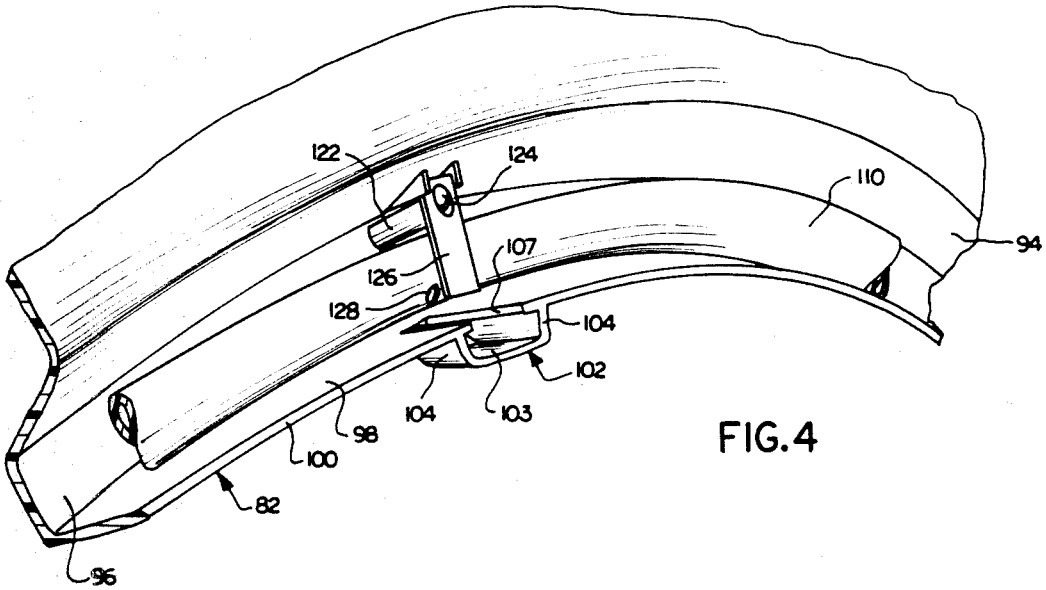
FIG. 4 is an enlarged, fragmentary, perspective view, showing details of the water manifold and spray channels.

It will therefore be seen, as shown in FIG. 2, that, when mounted in place, the balance ring 40 generally fits close enough to the neck 36 of the flaring portion 37 to prevent any escape of clothes from the interior of the spin tub. Furthermore, the balance ring projects a sufficient distance radially into the interior of the spin tub that it effectively serves as a clothes guard structure to prevent the escape of small articles of clothing from the interior, particularly when the tub is at its highest fill level. Furthermore, since the ring has a high density and is located at the highest point on the spin tub, when the spin tub goes into rotation, the ring provides a gyroscopic stabilizing effect to minimize movement of the tub assemblies with respect to the cabinet of the washing machine. Additionally, since the balance ring is held in place solely by the bolts 41 and can be removed from above, there is no need to remove the spin tub 30 from the washing machine to replace the balance ring if it becomes damaged and replacement is required.

The sidewall 34 of the outer tub 22 extends upwardly to a point higher than the top edge 38 of the spin tub and the balance ring 40. The outer tub 22 may be made of a suitable plastic material, such as a filled polypropylene, or it may be made in the more usual manner of a porcelain-enameled steel. In the plastic construction shown in FIG. 2, the sidewall 34 terminates at its upper end in a top edge 80, and a radially extending bead 81 is formed around the tub wall on the outer side adjacent the top edge. The top cap or tub cover, indicated generally at 82, is secured to the outer tub 22 and extends inwardly over the spin tub 30 and balance ring 40. To mount the top cap 82, it is provided at its outer edge with a pair of outer and inner walls 84 and 85 extending downwardly on either side with the tub sidewall 34, and a suitable sealing gasket 86 is positioned between the walls 84 and 85 and a top tub edge 80, to prevent any water leakage at this point. The top cap 82 is then secured to the tub by suitable spring clips indicated at 90, which are provided at a plurality of spaced locations around the periphery of the tub and to cap.

The top cap 82 has an inwardly extending, horizontal wall 92 which, a spaced distance inward from the outer tub sidewall 34, is joined to a vertically extending annular wall 93 and a curved wall 94 which curves inwardly and upwardly to a point located above the balancing ring 40 and having substantially the same height above the top edge 80 as the vertical wall 93. These two walls 93 and 94, in effect, form a trough to collect any water that spills out of the tub over the top cap 82 and are provided with suitable drain holes (not shown) whereby any water or suds that collect in this area may drain back through the top cap into the interior of the outer tub 22. At the upper inner end of the curved wall 84 is joined a top wall 96, which slopes slightly upwardly and extends radially inwardly to a point defining a generally circular diameter slightly less than the inner diameter of the balance ring 40. At this point, the top wall 96 joins a downwardly extending inner wall 98 which extends downwardly with a slight slope to terminate at a bottom edge 100 just above the balance ring 40 to define a reduced opening with respect to the balance ring 40 to prevent articles of clothing from entering this area and possibly passing into the peripheral space between the spin tub and the outer tub, as previously described herein.

The top cap 82 provides a number of functions in the washing machine, such as mounting the water inlet, a lint filter, and a bleach dispenser. The incoming water to fill the machine comes from the supply lines for both hot and cold water through solenoid valves, a vacuum break to the top cap, where conventionally it connects to a spray nozzle on the top cap for discharging the water downwardly into the spin tub through a suitable nozzle. However, in the present invention, it is intended that the incoming fill water be deflected downward at a plurality of points around the periphery of the top cap for more uniform distribution of the water during the fill cycle and better water distribution during the spray/rinse portion of the cycle. According to the present invention, a plurality of spray channels 102 are formed around the inner periphery of the top cap 82 on the inner sides of the inner wall 98. The spray channels 102 are all of identical construction, and each includes a deflector wall 103 extending vertically a spaced distance inward of the inner wall 98 and downwardly to the bottom edge 100 of the inner wall 98. The deflector wall 103 is enclosed by sidewalls 104 extending from the deflector wall 103 radially outward to the inner wall 98, as well as a sloping upper wall 105. At each of the spray channels 102, an opening 107 is formed in the inner wall 98.

A spray tube 110 is positioned on the underside of the top cap 82 directly below the top wall 96, and extends substantially around the entire periphery of the top cap 82. The spray tube 110 has an entry end 112 on one side of the lint filter, indicated generally at 114, and extends on a constant radius around the periphery to the other side of the lint filter 114, where it is closed off as indicated at 116. The spray tube 110 may be formed of an appropriate rigid material such as polyethylene or polypropylene, and a closed end 116 may be formed by a pinching operation wherein the sides of the tube are welded together to close off the end.

Adjacent each of the spray channels 102 and extending downwardly from the top wall 96 is an inner post indicated at 118 molded integrally with the top cap 82 and being provided with a projection 120 which fits within a suitable opening in the spray tube 110 with a relatively tight fit to positively anchor the spray tube 110 against radial movement. Radially outward of the inner post 118 and the spray tube 110 is an outer post 122, also formed integrally with the top cap 82, extending downwardly to a point adjacent the bottom edge of the spray tube. The outer post 122 is positioned to engage the side of the spray tube 110 and is provided with an axial bore 123 to receive a suitable screw 124 holding a sheet metal clamp 126 in place, with the clamp in engagement with the underside of the spray tube. With this arrangement, the spray tube 110, which has a fair amount of natural rigidity, is firmly anchored at at least four places around the periphery of the top cap to allow easy assembly and disassembly if necessary for replacement.

Adjacent each of the spray channels 102, the spray tube 110 is provided with a spray hole or opening 128 positioned in a direction to provide a water spray from the interior of the spray tube 110 to flow inwardly and downwardly to impinge on the deflector wall 103 of the spray channel. When the water strikes the deflector wall 103, the stream is broken up and, while confined by the deflector wall and sidewalls 104, is directed downwardly onto the clothes in the interior of the spin tub, thereby providing a spray at a plurality of points on the interior of the spin tub. It will be seen that the configuration of the spray can be varied by the number of spray channels 102 formed around the periphery of the top cap 82, as well as by the configuration and position of the deflector wall 103, its position with regard to spray tube 110, and the diameter and precise location of the spray hole 128. It will be understood that the particular configuration shown in the drawings is by way of example, and that desired additional spray channels could be provided around the periphery of the top cap inner wall 98, and these spray channels could be varied in configuration and the spray hole 128 varied in diameter as required for the proper spray action.

Although the preferred embodiment of this invention has been shown and described, it should be understood that various modifications and rearrangements of the parts may be resorted to without departing from the scope of the invention as disclosed and claimed herein.

What is claimed is:

1. A washing machine having an outer tub with an open top, a spin tub mounted inside said outer tub for rotation about a vertical axis and having an open upper end adjacent the outer tub open top, said open upper end having an outwardly and upwardly flaring surface, a weighted balance ring mounted on the inside of said flaring surface and extending radially inwardly toward said vertical axis partially over said open upper end, said balance ring having projecting bosses at a plurality of spaced points around its periphery extending toward and in abutting contact with said flaring surface, a threaded fastener at each of said bosses extending through said spin tub and engaging said balance ring at each of said bosses to clamp said boss against said flaring surface, said balance ring contacting said spin tub only at said bosses, said balance ring having a rigid core of weight material and a layer of plastic material completely covering and enclosing said weight material.

2. A washing machine as set forth in claim 1, wherein said balance ring has a flat annular upper surface terminating at the radially inner end at an upwardly extending annular wall formed of said plastic material.

3. A washing machine as set forth in claim 1, wherein said weight material is a concrete aggregate.

* * * * *